US010897946B2

(12) United States Patent
Plon

(10) Patent No.: US 10,897,946 B2
(45) Date of Patent: Jan. 26, 2021

(54) SECURABLE HAT

(71) Applicant: Richard Stanley Plon, Irvine, CA (US)

(72) Inventor: Richard Stanley Plon, Irvine, CA (US)

( * ) Notice: Subject to any disclaimer, the term of this patent is extended or adjusted under 35 U.S.C. 154(b) by 295 days.

(21) Appl. No.: 15/699,014

(22) Filed: Sep. 8, 2017

(65) Prior Publication Data

US 2018/0055127 A1 Mar. 1, 2018

Related U.S. Application Data

(63) Continuation-in-part of application No. 14/806,377, filed on Jul. 22, 2015, now abandoned.

(51) Int. Cl.

| | |
|---|---|
| ***A42B 1/20*** | (2006.01) |
| ***A42B 1/24*** | (2006.01) |
| ***A42B 1/06*** | (2006.01) |
| ***A42B 1/00*** | (2006.01) |
| ***A42B 1/02*** | (2006.01) |

(52) U.S. Cl.

CPC ..... *A42B 1/24* (2013.01); *A42B 1/006* (2013.01); *A42B 1/02* (2013.01); *A42B 1/062* (2013.01); *A42B 1/201* (2013.01)

(58) Field of Classification Search

CPC ..... A42B 1/006; A42B 1/02; A42B 1/245; A42B 1/12; A42B 1/069; A42B 1/008; A42B 1/04; A42B 1/201

USPC ..... 2/209.13, 209.11, 171.3, 171.6

See application file for complete search history.

(56) References Cited

U.S. PATENT DOCUMENTS

| | | | | |
|---|---|---|---|---|
| 1,414,797 | A | | 5/1922 | Trau |
| 2,710,639 | A | | 6/1955 | Farls |
| 2,771,230 | A | * | 11/1956 | Fitzpatrick ..... A42B 1/248 224/254 |
| 4,556,993 | A | | 12/1985 | Okamura, Sr. |
| 4,932,574 | A | | 6/1990 | Doshi |
| 5,511,705 | A | | 4/1996 | Dreszer |
| 5,799,335 | A | | 9/1998 | Ethier |

(Continued)

FOREIGN PATENT DOCUMENTS

| | | |
|---|---|---|
| FR | 2741241 A1 | 5/1997 |
| JP | 3139676 U | 2/2008 |

(Continued)

OTHER PUBLICATIONS

European Search Report(extended) application No. PCT/US2016040955, dated Feb. 2, 2019.

(Continued)

*Primary Examiner* — Jillian K Pierorazio

(74) *Attorney, Agent, or Firm* — Carlos A. Fisher; Stout, Uxa & Buyan, LLP

(57) ABSTRACT

The present invention provides hats with attachment assemblies allowing them to be detachably secured to an article of clothing. In one example, the attachment assembly permits the hat to be detachably secured in an exterior-side out configuration to a belt of medium width worn around the wearer's waist, without requiring the hats to be inverted or reversed, and without any need for pockets, linings, zippers or the like. The hats may also be provided with retention members for holding the hats in a simple folded configuration when carried on the person. In such a configuration small personal items such as keys, loose change, mobile telephones may be carried in the retained, folded hat.

6 Claims, 14 Drawing Sheets

(56) References Cited

U.S. PATENT DOCUMENTS

| | | | | |
|---|---|---|---|---|
| 5,890,638 | A * | 4/1999 | Woloshen | A45F 5/02 224/191 |
| 6,167,569 | B1 | 1/2001 | Conner, IV | |
| 6,230,331 | B1 | 5/2001 | Aguilar et al. | |
| 6,237,159 | B1 | 5/2001 | Martin | |
| 6,317,892 | B1 * | 11/2001 | Galigani | A42B 1/201 2/209.11 |
| 6,467,096 | B1 * | 10/2002 | Coluccio | A42B 1/22 2/171 |
| 6,484,323 | B1 | 11/2002 | Pu | |
| D496,146 | S | 9/2004 | Appleberry | |
| 6,877,168 | B1 * | 4/2005 | Duffy | A42B 7/00 132/57.1 |
| 7,011,241 | B2 | 3/2006 | Godshaw et al. | |
| 7,036,155 | B2 | 5/2006 | Rugg | |
| 7,257,845 | B1 | 8/2007 | Conner, IV | |
| 7,556,374 | B1 | 7/2009 | Cooper | |
| 7,938,533 | B2 | 5/2011 | Shapiro | |
| 8,267,289 | B2 | 9/2012 | Irvin | |
| 2004/0210982 | A1 | 10/2004 | Kronenbeger | |
| 2005/0128430 | A1 | 6/2005 | Uren | |
| 2006/0048279 | A1 | 3/2006 | Bartos | |
| 2006/0273129 | A1 | 12/2006 | Horn | |
| 2007/0087794 | A1 | 4/2007 | Choi | |
| 2008/0201821 | A1 | 8/2008 | Bryant | |
| 2009/0055995 | A1 * | 3/2009 | Garza | A42B 1/006 2/209.11 |
| 2010/0212066 | A1 | 8/2010 | Gilman | |
| 2012/0096626 | A1 | 4/2012 | Edwards | |
| 2014/0047617 | A1 * | 2/2014 | Abers | A42B 1/245 2/209.13 |
| 2014/0137310 | A1 * | 5/2014 | Malone | A42B 1/008 2/171.2 |
| 2014/0230129 | A1 | 8/2014 | Viviani | |
| 2014/0263494 | A1 | 9/2014 | Treska | |
| 2014/0320798 | A1 | 10/2014 | Tribelhorn | |
| 2015/0115008 | A1 | 4/2015 | Griffith | |
| 2015/0305423 | A1 * | 10/2015 | Pusateri | A42B 1/069 2/2.5 |
| 2017/0020220 | A1 | 1/2017 | Plon | |

FOREIGN PATENT DOCUMENTS

| | | | |
|---|---|---|---|
| KR | 200311535 | Y1 | 5/2003 |
| NL | 1024962 | C1 | 6/2005 |
| WO | 8303527 | A1 | 10/1983 |

OTHER PUBLICATIONS

International Search Report, application No. PCT/US18/48723, dated Dec. 18, 2018.

Patent Search Report, Cardinal Intellectual Property, report dated Apr. 21, 2015.

www.wellpromo.com, Wholesale—Fold N' Go Fisher Hat, dated Apr. 20, 2015.

www.amazon.com, Twist-and-Fold Hat Women's Foldable Cotton Sun Hat, 18 in diameter brim, dated Apr. 20, 2015.

www.sagemember.com, Folding Fisher Hat, dated Apr. 20, 2015.

www.amazon.com, Rfid Travel Wallet, dated Apr. 20, 2015.

www.jaminleather.com, Black Leather Clip-On Poucn w/Key Ring, dated Apr. 20, 2015.

International Search Report, application No. PCT/US2016/040955. dated Nov. 3, 2016.

Australian Examiniation report application No. 2016295313, dated Mar. 6, 2020.

* cited by examiner

SECURABLE HAT

RELATED APPLICATIONS

This application is a continuation-in-part of U.S. patent application Ser. No. 14/806,377, filed Jul. 22, 2015, which is hereby incorporated by reference herein in its entirety.

FIELD OF THE INVENTION

The present invention relates to hats and, in particular, to hats that can be secured to articles of clothing. More specifically, the invention relates to hats that can be secured to the body for storage; in preferred examples the hats of the present invention are structured to be secured to a belt worn on the person, for example, around an individual's waist.

BACKGROUND

Hats are a valuable defense against the sun and inclement weather. Available in a wide variety of shapes, sizes, and styles, they may shield the wearer's eyes from glare, may protect the head from excessive heat and cold, and may reduce the risk of skin cancer. However, a perennial question remains concerning how and where one is to store or carry a hat that is not currently being worn; for example, when the wearer is indoors or at nighttime. Hats are constantly lost or misplaced as a result of their owners simply forgetting where they set them down or left them, or when a hat slips onto the floor unnoticed.

U.S. Pat. No. 5,799,335 to Ethier and U.S. Pat. No. 7,257,845 to Conner disclose convertible hats that can be reassembled into handbags, shoulder bags, satchels, fanny packs or the like. However, each of these hat designs is somewhat complicated and requires that the hat be folded, collapsed, turned inside out, or otherwise inverted in a way that would not be intuitive or convenient to most users. Furthermore, although Ethier and Conner disclose embodiments in which the hat may be converted in form, for example, to a fanny pack or a self-containing bag or other container, and worn joined to an elastic cord or strap that is incorporated as part of the convertible hat for use in one or more of these other, "non-hat" forms. Furthermore, none of these convertible hats is structured and designed to be fastened to a separate, medium-width belt of the type normally worn with slacks, jeans or similar casual clothing.

U.S. Pat. No. 6,317,892 to Galigani, U.S. Pat. No. 7,036,155 to Rugg, U.S. Pat. No. 6,320,331 to Aguilar et al., and international patent application US20060048279 by Bartos, all show hats provided with hard fasteners such as clasps, clips, or rings for attachment to a belt. These rigid fasteners can be problematic, however, in that their hardness makes them uncomfortable if they rub against the user's head. They also may be somewhat costly, prone to breakage, bulky, and easily lost.

Accordingly, there is a long-felt need for hats that can easily be secured to belts of a wide variety of width in a simple and intuitive fashion, are inexpensive to manufacture, and do not require separate extra parts.

SUMMARY

The present invention provides hats with attachment assemblies allowing them to be detachably secured to the wearer's body, for example to a waistbelt. The attachment assembly is configured to be joined to a standard belt worn around the wearer's waist, preferably without requiring the hats to be inverted, reversed, or folded in a complex fashion, and without the need for pockets, linings, zippers, bags, or the like.

In its simplest, most basic form, a hat according to the present invention may comprise a crown portion, an optional brim portion, and an attachment assembly. The attachment assembly may comprise, for example, at least one strip of suitably flexible material, for example, a fabric material, a leather material, a polymeric material and/or an elastomeric material, having at least one of a first end and a second end attached to the exterior side of either the brim or crown portion, with the unattached end, if any, being attachable by any suitable fastener (such as, without limitation, a snap fastener, a hook fastener, a magnetic fastener, a buckle (such as a polymeric sliding side-release buckle), a button fastener, an alligator clip-type fastener, and/or a hook and loop VELCRO®-type fastener). Preferably, but not necessarily always, the first and/or second ends and any fasteners are arranged to permit the ends of the strip to be attached to the exterior side of the crown portion along a substantially vertical axis relative to the orientation of the hat while it is being worn. However, in some examples the ends of the strip are fastened, or are structured to be fastened, to one or more interior portion of the brim or crown. A substantially vertical axis shall mean an axis within about 45° of the vertical. The strip is of sufficient length, preferably at least about 1.25", or at least about 1.50", or at least about 1.75" in length, to enable an ordinary belt of at least medium width to be extended through it.

In one example, a single strip is provided, in the form of a length of material that is joined (e.g., by sewing) and/or fastened (i.e., by a suitable fastener) to the exterior of the hat crown and/or brim in such a way as to define a loop. In another exemplary example, the strip is defined in the form of material located between two closely spaced, similarly oriented slits in the crown or brim portion material. In this latter example, the first end and second end of the strip are joined to and continuous with the material of the portion. In some examples, the attachment assembly may be joined to the brim portion. In some examples, the attachment assembly may be joined to the crown portion. Additionally and independently, however the attachment assembly may otherwise be configured, the attachment assembly may in a particular case comprise a plurality of strips, such as two, three, four or more strips.

As disclosed above, in some examples, one end of the strip is detachably fastened to the crown portion, so that the loop can easily be opened up, wrapped around the wearer's belt, and then fastened, without requiring the user to unfasten the belt from around his or her body or fold the hat into another form. In other examples, the attachment assembly may be joined to the brim portion of a hat, or may bridge the brim and crown portions thereof.

In addition, in some examples, the hat is formed of sufficiently flexible material to allow it to be folded, for example, in one or more pleat when the hat is attached to a belt using the attachment a assembly. Optionally, the hat may also have at least one retention member comprising one or more suitable fastener for holding the hat in a folded position when secured to the belt.

In certain examples, the hat may have one or more magnet secured in a crown portion or a brim portion hereof, with a magnetically attractive material secured in an opposing part of the hat. For example (and without limitation), in the case that the hat is a "newsboy" or "cheese cutter" type hat the magnet(s) may be secured in the bottom of the back of the crown, and the magnetically attractive material may be secured in the front edge of the crown, or in the front portion of the brim. The attachment apparatus may be located on the outside of the back of the crown portion. In this way when the hat is secured to the user's belt the hat may be securely folded by flipping the brim down so that the magnets and magnetic material come into proximity with each other. In such cases, the interior of the crown may be used to provide a convenient carrying pouch for keys, cell phone and other items.

Of course, the fasteners required to retain the hat in a securely folded conformation need not be magnets, but may alternatively be any other suitable and secure fastener type.

In another example, the present invention may comprise a short strap or cord (hereinafter "cord") having a fastener at a plurality of positions or ends thereof. The cord may comprise one or more strands. In one example, the cord may comprise the same type of fastener at each such position or end; in another example, the plurality of ends may comprise two or more different fasteners. The cord may in certain cases comprise a natural or synthetic elastic material such as a material having flexibility along the linear axis of the cord. Additionally, or alternatively the cord may be made of any suitably strong lightweight material, such as a strip or braided material comprising leather, a polymer, cloth and/or metal.

In some examples, the cord may comprise fasteners at two ends thereof comprising magnetically attractive materials, such as a magnet at one end and an iron material at another end, or magnets oriented to bring magnetically attractive opposite poles together. In such an example the cord may comprise one or more fasteners are structured to attach to a hat. For example, the hat may comprise a female portion of a sliding side-release buckle such as those seen in backpacks or laptop carrying cases, while the male portion is attached at a point midway along the cord.

In use, the cord may be fastened to a hat at one end thereof, and to an article of clothing on the other end. This is particularly simple when, for example, alligator-type clips are used; one clip can be used to retain the brim or crown portion of a hat, while another end of the cord may be used to clip the cord and hat to a belt, a shirt or trouser waist. Of course, the ends of the cord may also be fastened to the hat at more than one end, thus resulting in a cord loop which can then be worn around the neck.

BRIEF DESCRIPTION OF THE DRAWINGS

Additional aspects and examples of the present invention will become evident upon reviewing the non-limiting examples described in the specification and the claims, which may be taken in conjunction with the accompanying figures. Herein, like numerals in the drawings and specification designate like elements, and:

DETAILED DESCRIPTION OF THE INVENTION

Figure 1:
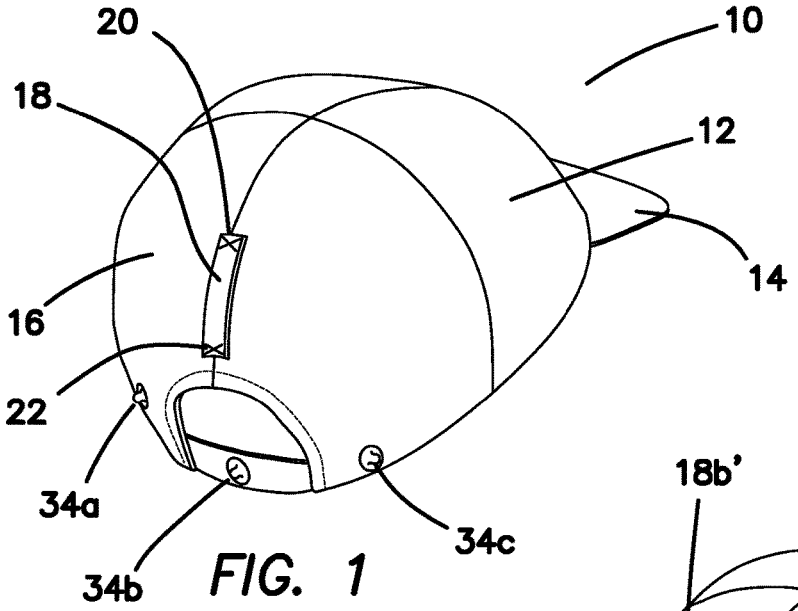
FIG. 1 is a ¾ perspective view from the rear of an example of the invention.

In accordance with a first exemplary embodiment of the invention, FIG. 1 shows a cap 10 having a generally dome-shaped crown portion 12 configured to engage a wearer's head, and a brim portion 14, (here a visor or bill), that projects outwardly from a forward portion of the cap. It will be understood that in some examples of the invention the brim portion may be absent, or may partially or wholly extend around the crown portion. An attachment assembly 16 is provided for attachment of the hat to a belt on the wearer's waist.

In the example shown in FIG. 1, the attachment assembly comprises a single strip 18 of material, such as a denim or canvas fabric. First and second ends (20, 22) of the strip 18 are joined to the eternal back portion of the crown in such a way that the strip 18 and the underlying portion of the crown together define a loop through which the end of medium-width belt may be passed. In this example the opposite ends 20, 22 of the strip 18 are sewn to the crown 12. It will be understood that any appropriate means of joining the strip ends 20, 22 to the crown portion 12 of the hat, such as sewing or riveting, may be employed.

Figure 2:
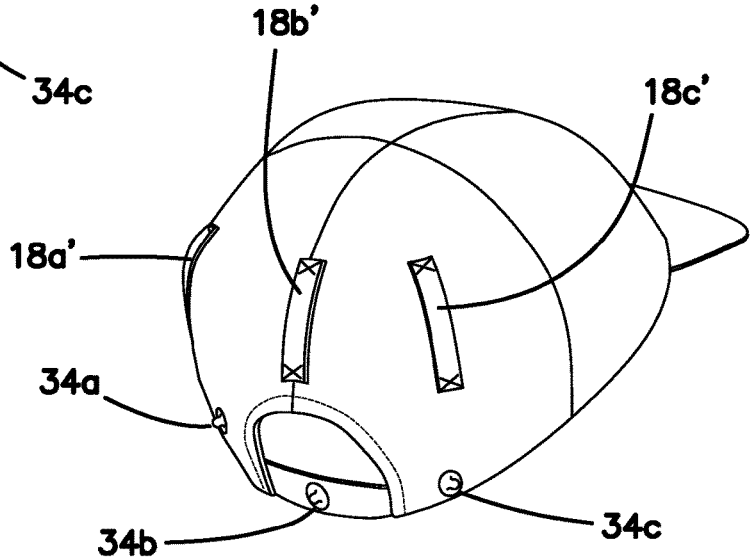
FIGS. 2-4 are fragmentary ¾ perspective views from the rear, showing alternate examples of the invention.

In an alternate example shown in FIG. 2, the attachment assembly 16' comprises a plurality of strips 18*a*', 18*b*', and 18*c*' joined to the hat at closely spaced intervals from one another. The spacing between strips is preferably no more than about 1"-3" or so; thus, for example allowing the hat to be gathered into pleat folds when attached to a wearer's belt.

Figure 3:
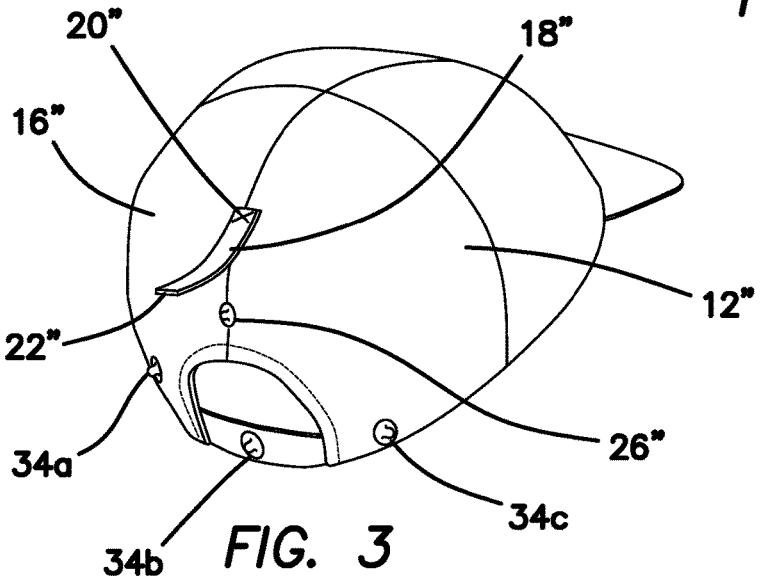

FIG. 3 shows another exemplary embodiment wherein the attachment assembly 16" comprises a flexible strip 18" having a first end 20" sewn to the crown portion 12" and a second end 22" fastened to the crown by means of a releasable connection between a first fastener element (not shown) on the second end 22" and a second fastener element 26" on the crown portion 12". The second fastener element 26" is shown here as a male snap fastener; the first fastener element is in this case a female fastener element. However, other releasable fastener elements such as buttons, hook and loop type fasteners and the like, are also suitable for use in attachment assemblies of this type. Of course, the hat may comprise two or more such strips suitably oriented to all be joined to a single belt in other examples.

A useful feature of attachment assemblies such as those shown in FIG. 3 and described above is that the hat may advantageously be joined to the user's belt without taking the belt off by looping the strip around the belt and fastening the first and second fastener elements of each strip component.

Figure 4:
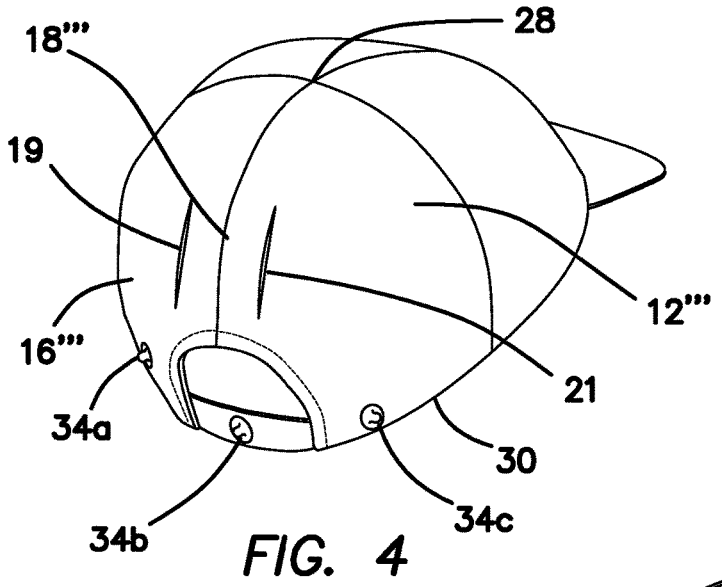

FIG. 4 shows still another example, wherein the attachment assembly 16''' comprises a strip 18''' which is defined as an integral portion of the crown portion 12''' disposed between a pair of closely spaced-apart slits 19, 21. In this example, the user secures the cap to the belt by inserting the free end of the belt into one of the slits 19, passing it under the strip 18''', and then pulling it out through the other slit 21 before buckling or otherwise fastening the belt.

The strip or strips 18 in each of the examples shown FIGS. 1-4 preferably extends in a substantially radial and vertical orientation toward the apex 28 of the hat 10.
That is, the strip should extend at an angle of no more than about 45° away from a straight line extending between the bottom edge 30 and the apex 28 of the hat 10. In this way, a hat, particularly a soft, foldable hat, may be oriented when worn on a belt in a manner permitting the hat to take up less bulk room on the belt than it might otherwise do.

Figure 5:
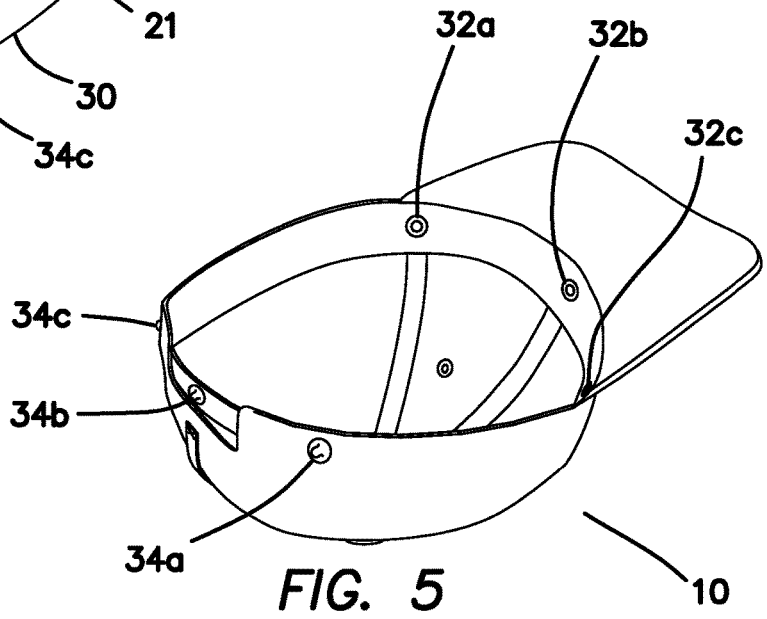
FIG. 5 is a fragmentary perspective view showing a hat according to any one of FIGS. 1-4 in an inverted position.
Figure 6:
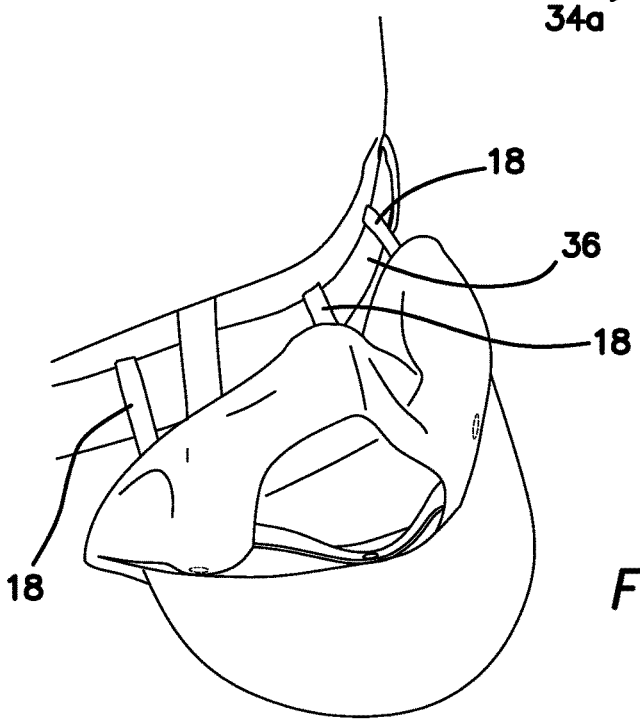
FIG. 6 is a fragmentary perspective view showing the hat of FIG. 1 being worn in a folded configuration on the belt of a user.

In an optional configuration, FIG. 5 shows an example in which the hat is a flexible cap; in this view the hat 10 in an inverted position so that its interior surface 32 is visible, revealing a plurality of fastener members mounted along the interior front edge of the hat 10. These fastener members, shown here as female snap fastener elements 32*a*, 32*b*, and 32*c*, are configured to releasably engage mating male snap fastener elements 34*a*, 34*b*, 34*c* mounted along the exterior rear edge of the hat 10 (see FIG. 1), to maintain the hat 10 in a folded position when it has been secured on the wearer's belt, as shown in FIG. 5. In this and similar configurations, the fastener members permit the cap to folded over itself to form a pocket (see e.g., FIG. 6). Thus, in this folded position, the hat 10 may also serve as a convenient receptacle for containing an item such as a cell phone 38 (see e.g., FIG. 8), wallet, car keys or the like.

The flexible strips 18 in each of the examples shown in FIGS. 1-6 are preferably long enough, and the positions at which they are joined to the crown portion of the hat sufficiently widely spaced, to provide adequate clearance for a belt 36 of at least medium width, where the width of the belt is defined as the dimension extending transverse to the length or longitude of the belt. At present, a medium width belt is a recognized to be at least 1¼" wide, with at least ½" clearance required to allow the belt 36 to be easily slipped through loops defined by the strips 18. Thus, each strip 18 should preferably be at least about 1.25", or at least about 1.50", or at least about 1.75" inch.

Figure 7:
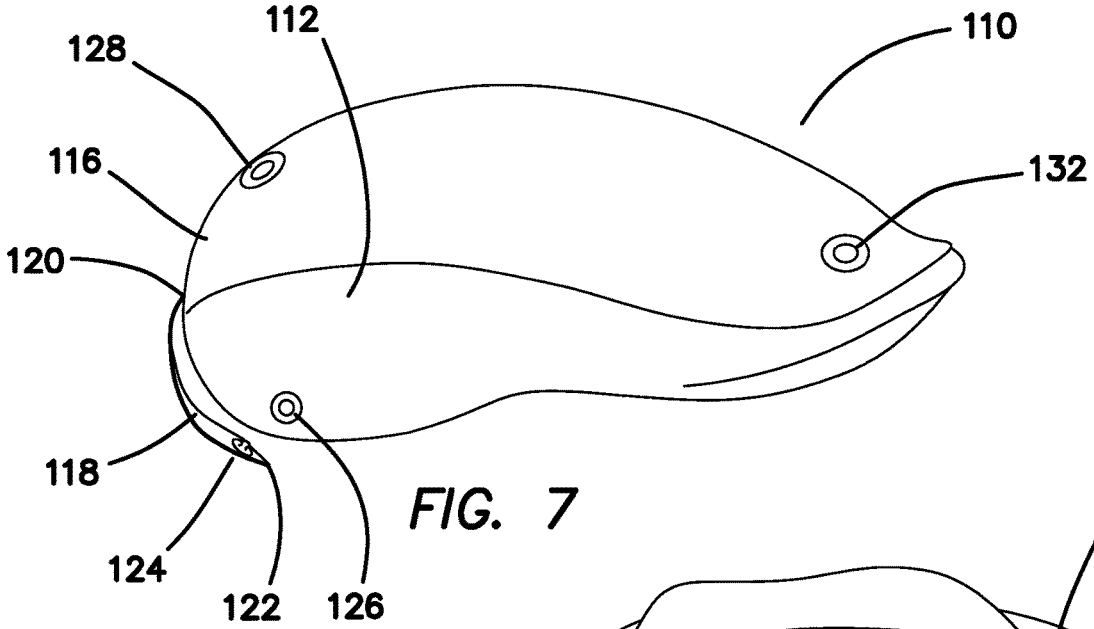
FIG. 7 is a ¾ perspective view from the rear of another exemplary embodiment of the invention.
Figure 8:
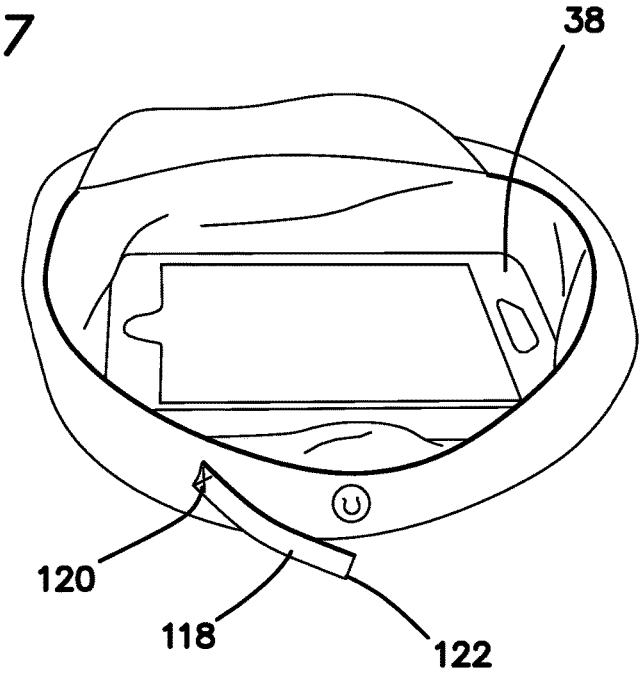
FIG. 8 is a perspective view showing the hat of FIG. 7 in an inverted position, with an item stored within.

FIGS. 7 and 8 show an alternate example of the hat 110, wherein the attachment assembly 116 comprises a flexible strip 118 that extends in a generally circumferential direction along the bottom rear edge of the crown of the hat 110. One end 120 of the strip 118 is sewn or otherwise permanently secured to the crown, while the other end 122 is provided with a first element of a releasable fastener member such as a male snap fastener element 124 that mates with a second fastener element of a releasable connection such as female snap fastener element 126 provided on the edge of the crown 112, preferably at a distance of at least about 1", or at least about 1.5", or at least about 2" away from the first end 120 of the strip 118. This arrangement serves to hold the strip 118 in place when the hat 110 is being worn on the user's head. However, when the hat 110 is removed from the wearer's head, the second end 122 of the strip 118 may be releasably secured to a third fastener element of a releasable connection such as female snap fastener element 128, which is provide on the rear portion of the hat, thus defining a loop which permits the hat to be attached to a belt when not in use.

Alternatively, the hat of FIG. 7 may be folded in two and the first fastener element 124 (in this case, a male fastening element) attached to a fourth fastening element 132 (in this case, female) provided on the exterior front portion of the crown or brim portion 112. This allows the hat 110 to be folded in two, forming a convenient receptacle for containing a cell phone 138 or the like.

As in the embodiment of FIGS. 1-6, the strip 118 is preferably at least about 1.25", or at least about 1.50", or at least about 1.75" inch, to enable it to form a loop with sufficient clearance to receive a belt of at least medium width. Furthermore, the strip should be form of sufficiently flexible material to enable it to be easily twisted from a generally circumferential orientation allowing the second end of the strip 118 to be secured to the second connection element 126 to a generally radial orientation allowing the second end of the strip to be secured to the third fastener element 128.

Figure 9A:
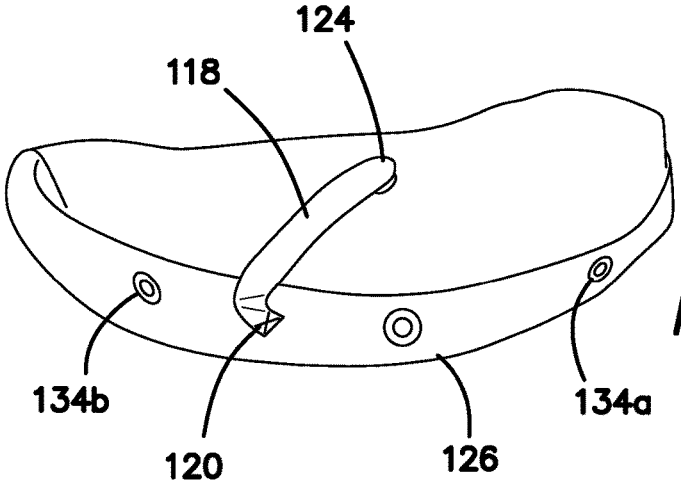
FIG. 9A is a perspective view of the hat of FIGS. 7 and 8 in a folded configuration.
Figure 9B:
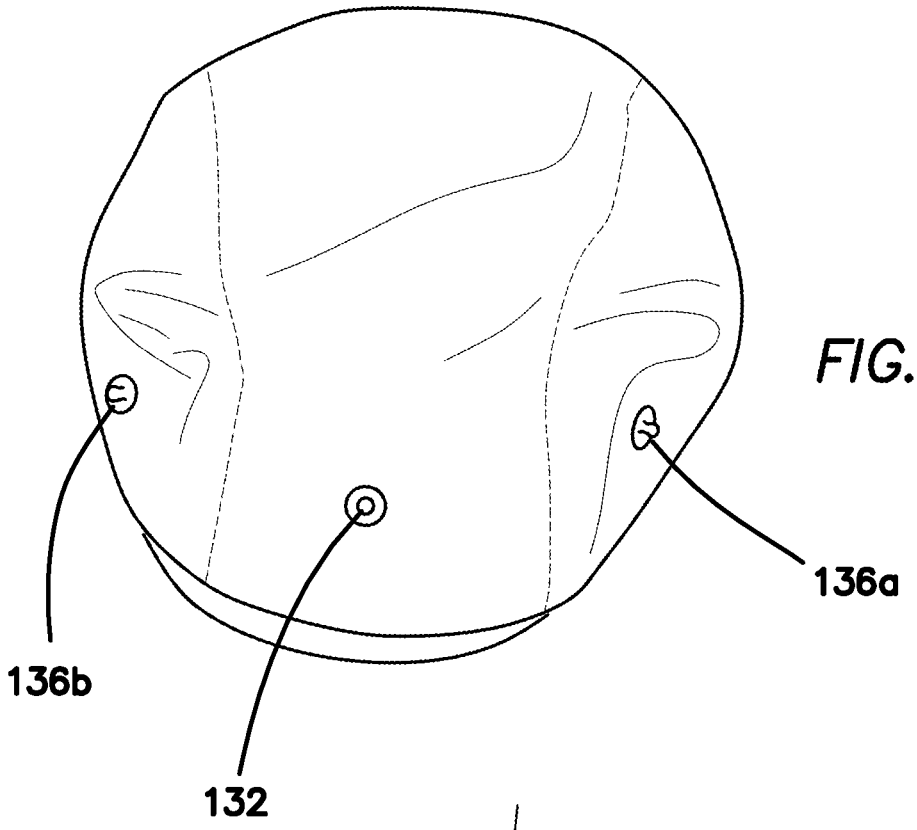
FIG. 9B is a top view of the hat of FIG. 9A in an unfolded configuration.

Turning now to FIGS. 9A and 9B, an alternative example of a flat cap is depicted. In this case, the attachment assembly is substantially similar to that shown on FIG. 7. However, fastener elements 134*a* and 134*b* (in this case female snap fastener elements) are present along the lower rear edge of the crown of the hat, and configured to be removably joined to complementary fastener elements 136*a* and 136*b* on the outer brim portion of the hat. In this way, the hat can be folded over as shown in FIG. 9A, with the send end 124 of the strip 118 joined to female fastener element 132 to create a loop for fastening the folded hat to a waist belt. The additional fastener elements help create a more secure pouch or pocket in which items may be carried while the hat is folded.

Figure 10:
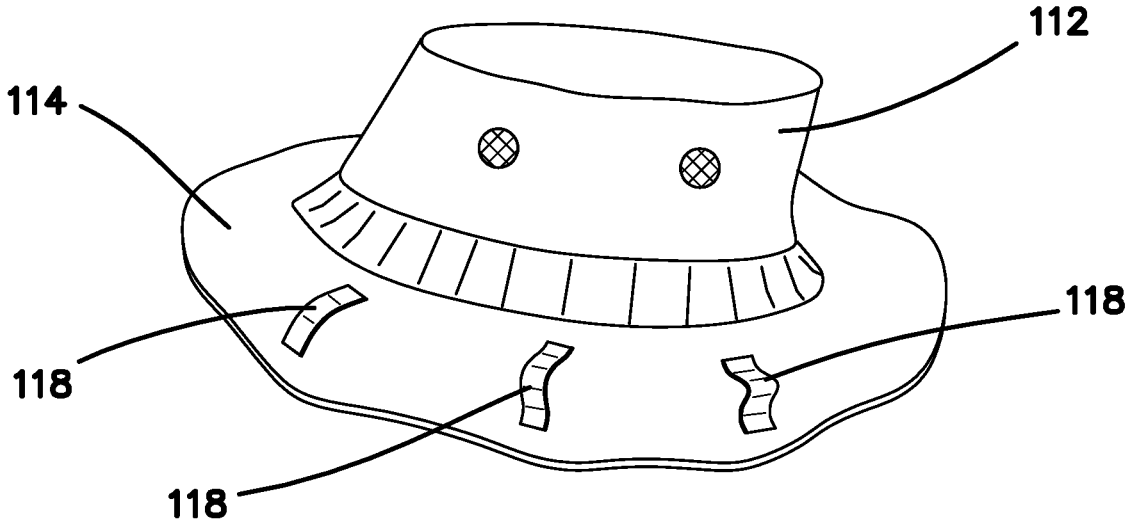
FIG. 10 is a side view of a "bucket"-style cloth hat of the present invention, showing an exemplary attachment assembly.

FIG. 10 shows a "bucket"-style cloth hat of the present invention, showing an exemplary attachment assembly. In this example, the attachment assembly comprises three cloth strips 118, with each strip having a first end 120 and second end 124 attached to the brim portion 114 thereof.

Figure 11:
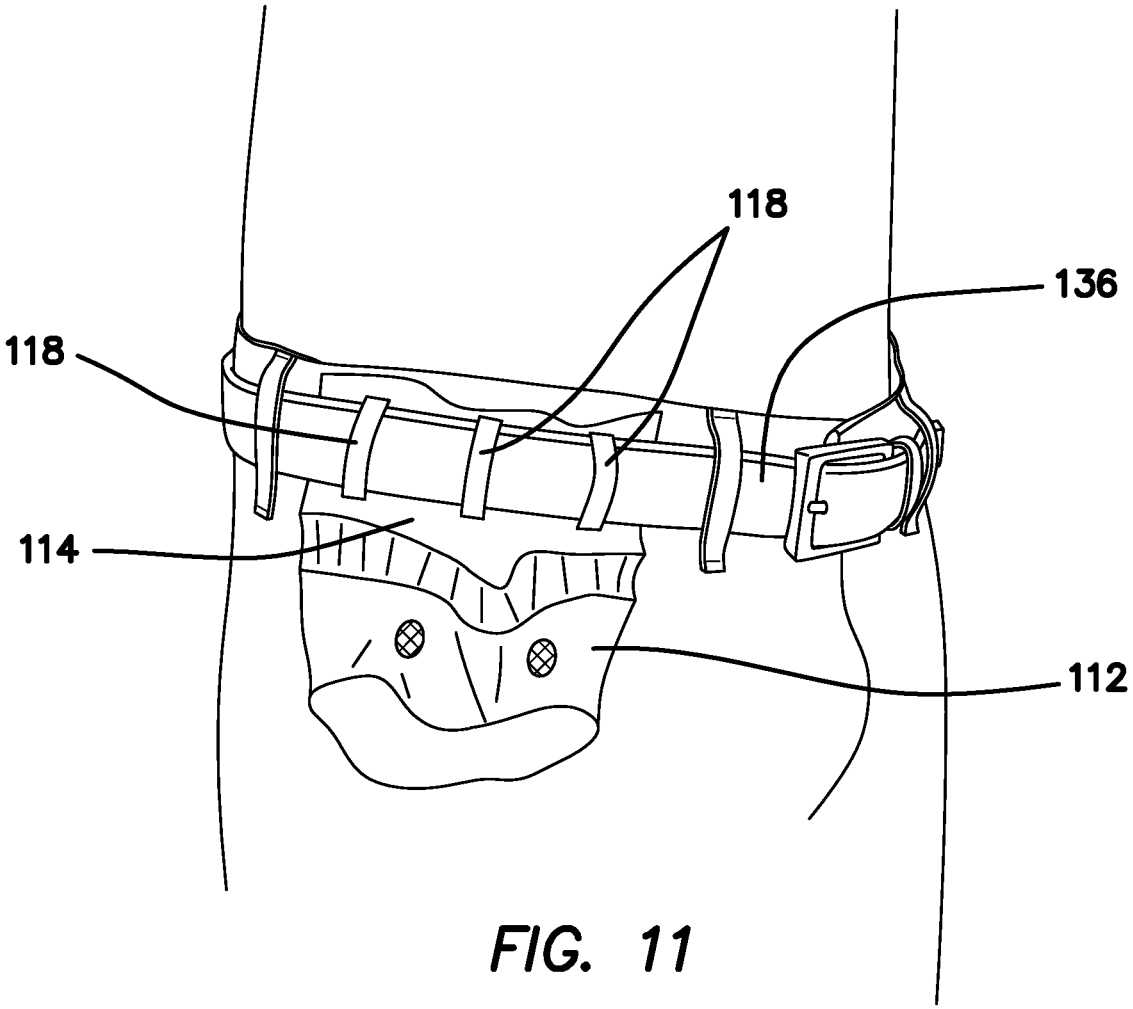
FIG. 11 is a view of the hat of FIG. 10 attached to a wearer's belt by the attachment assembly.

FIG. 11 shows the bucket-style hat of FIG. 10 attached to a waist belt 36 with the attachment assembly comprising strips 118.

Figure 12:
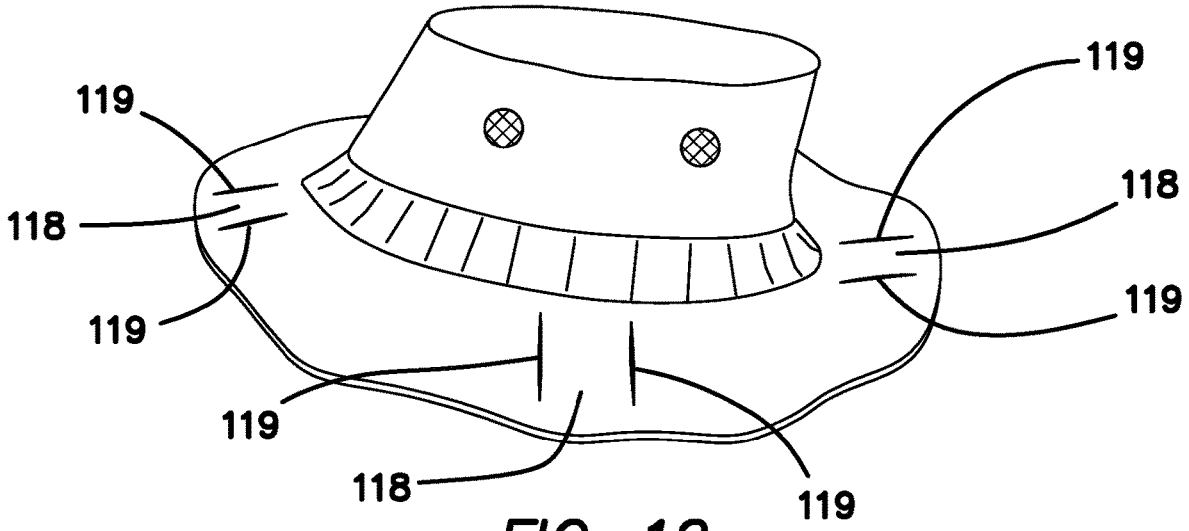
FIG. 12 is a side view of a "bucket"-style cloth hat of the present invention, showing an exemplary attachment assembly.

FIG. 12 shows a "bucket"-style cloth hat of the present invention, showing an exemplary attachment assembly. In this example, the attachment assembly comprises three strips 118, with each strip disposed between a pair of closely spaced-apart slits 119. In this example, the user may secure the cap to the belt by inserting the free end of the belt into one of the slits 119, passing it under the strip 118, and then pulling it out through the other slit 119 before buckling or otherwise fastening the belt.

Figure 13:
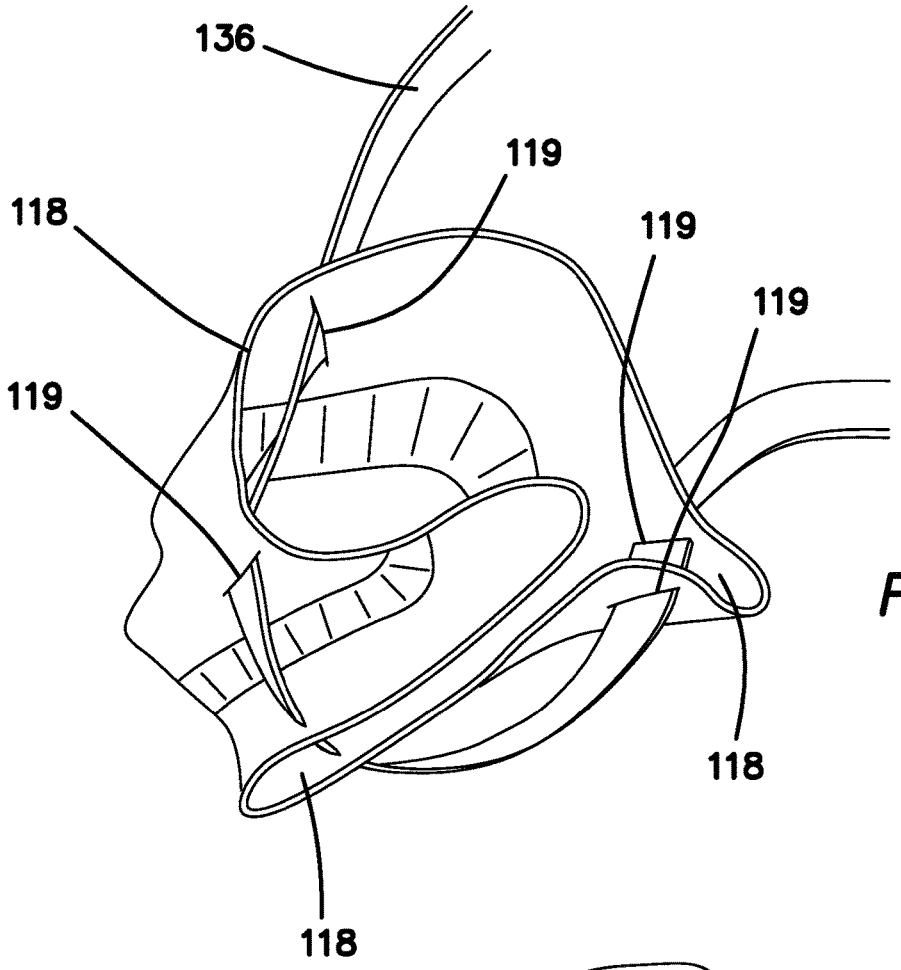
FIG. 13 is a view showing how a belt is threaded through the attachment assembly of the hat of FIG. 12.

FIG. 13 shows a way in which the hat of FIG. 12 may be attached to a waist belt 136 and folded before buckling or otherwise fastening the belt. The belt through each slit 119 and under each strip 118.

Figure 14:
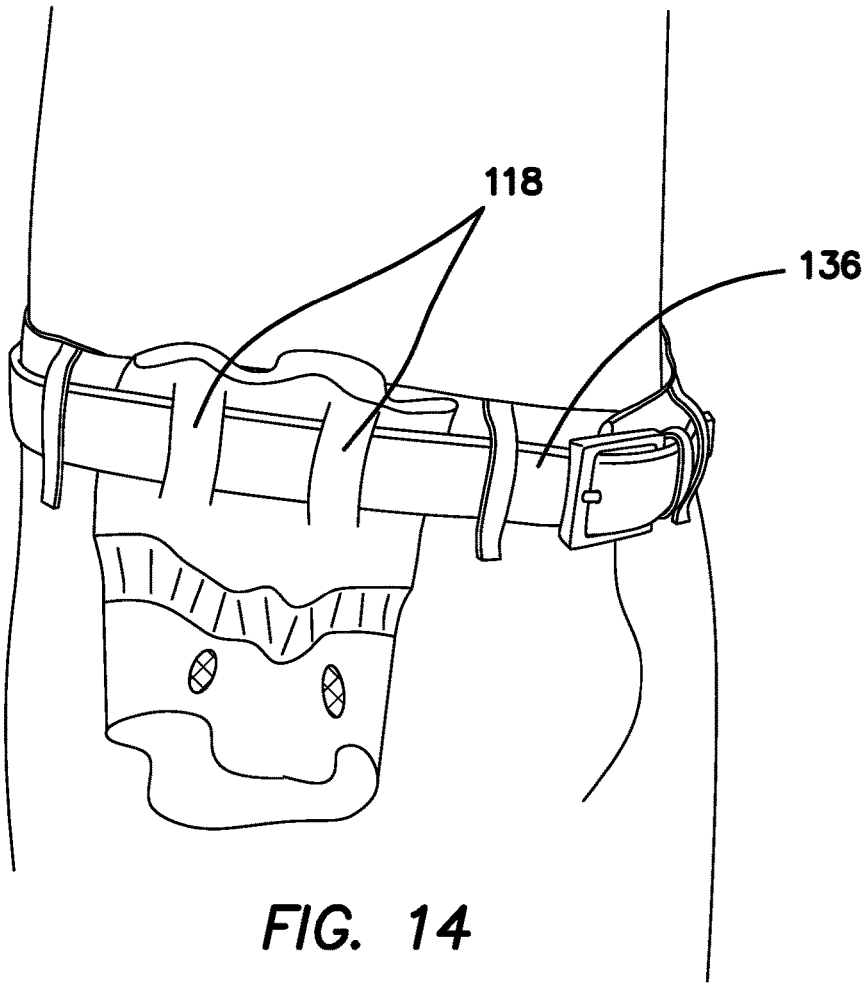
FIG. 14 is a view of the hat of FIG. 12 attached to a wearer's belt by the attachment assembly.

In this manner, when the belt 136 is cinched up and fastened, for example, as shown in FIG. 14, the hat is preferably carried in an inverted position, thereby providing a convenient pouch for keys, cell phone and other items.

Figure 16:
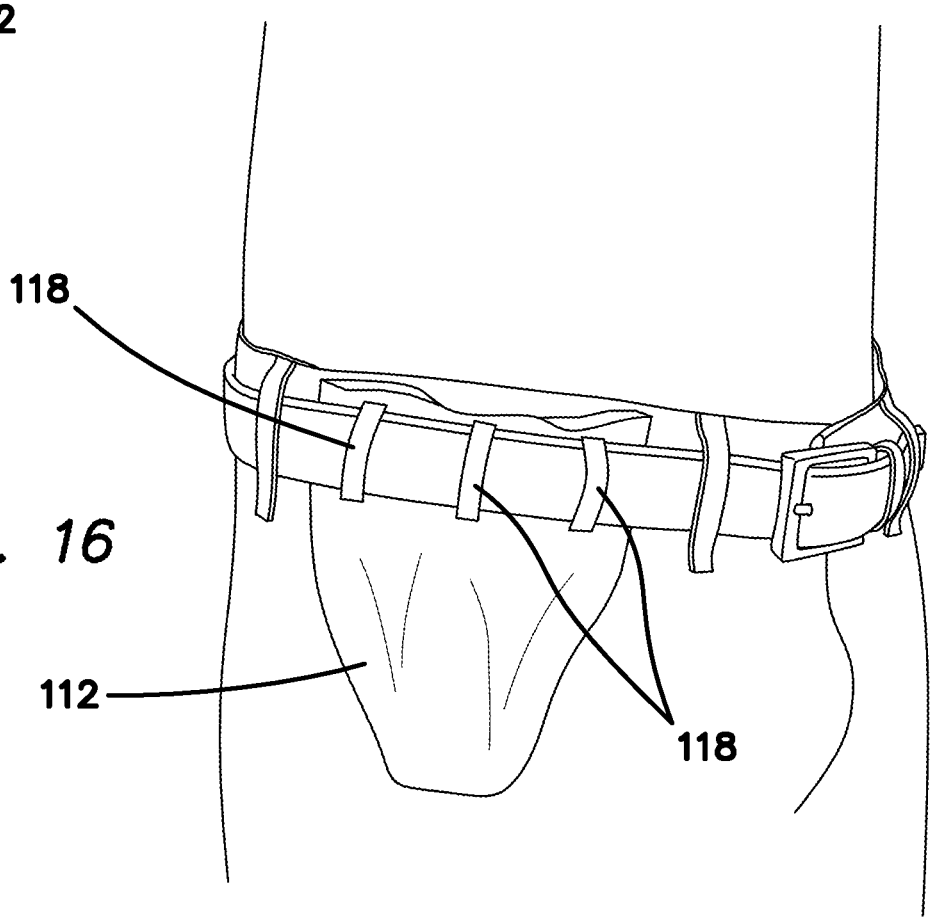
FIG. 16 is a view of the hat of FIG. 12 attached to a wearer's belt by the attachment assembly.
Figure 15:
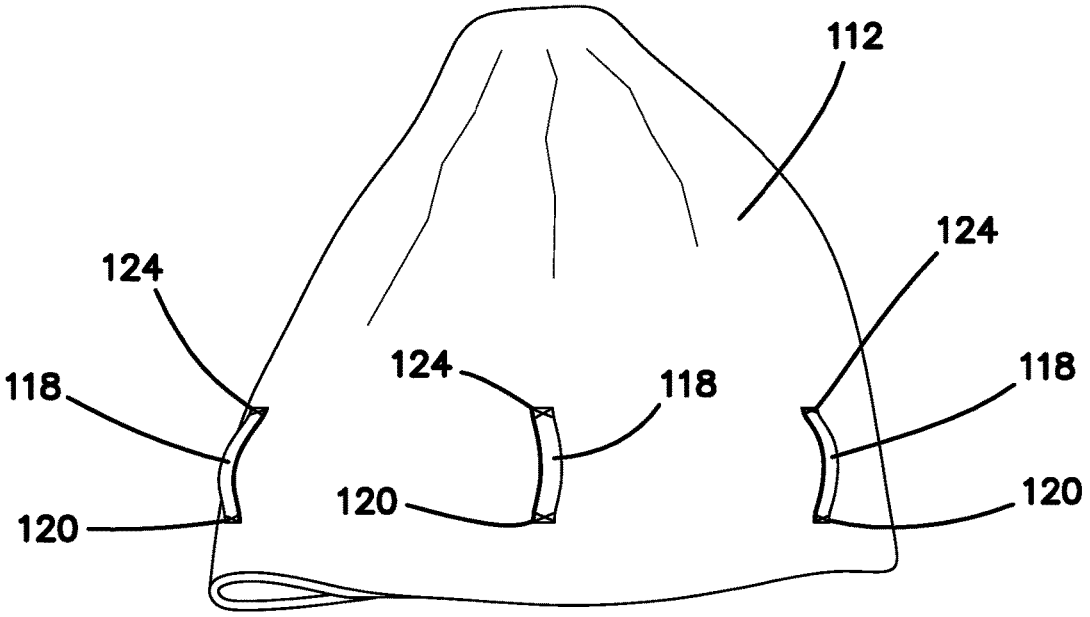
FIG. 15 is a side view of a woven watch cap or "beanie", having an attachment assembly joined along a side thereof.

Turning now to FIG. 15, a watch cap is depicted. In this example the watch cap comprises an attachment assembly having three strips 118, each strip having a first end 120 and second end 124 attached to the crown portion 112 of the cap. This cap can be fastened to a belt as shown in FIG. 16; in this configuration, a pouch may be formed as shown to hold items to be carried while the hat is folded; the side of the watch cap that is not joined to the belt by the attachment assembly (in FIG. 16, the inner portion of the watch cap behind the belt) may be held closed against the body by cinching the waist belt sufficiently tightly to prevent items carried in the pouch from spilling therefrom. Alternatively, the inner lower sides of the watch cap may comprise fastening elements.

Although the hat shown, for example, in the exemplary embodiments of FIGS. 1-6 is shown as a baseball-type cap, while the hat shown in other exemplary embodiments (such as FIGS. 7, 8, 9A and 9B, in which the hat is shown as a flat cap), the principles of the instant invention are not intended to be restricted to use with any particular style of hat, but can be applied with equal effectiveness to a wide variety of hats, including bucket hats, newsboy hats, fisherman hats, and the like.

Figure 17:
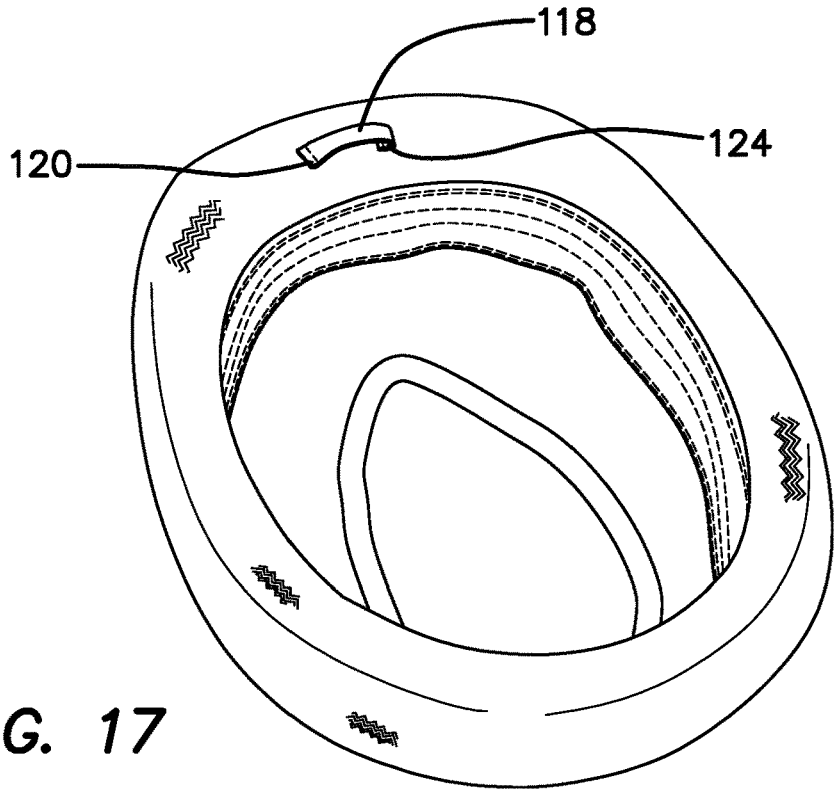
FIG. 17 is a bottom view of a Panama-style hat comprising an attachment assembly of the invention.

In FIG. 17 a straw fedora-type hat is shown, with an attachment assembly comprising a single strip 118 having a first end 120 and second end 124 sewn under the brim of the hat.

Figure 18:
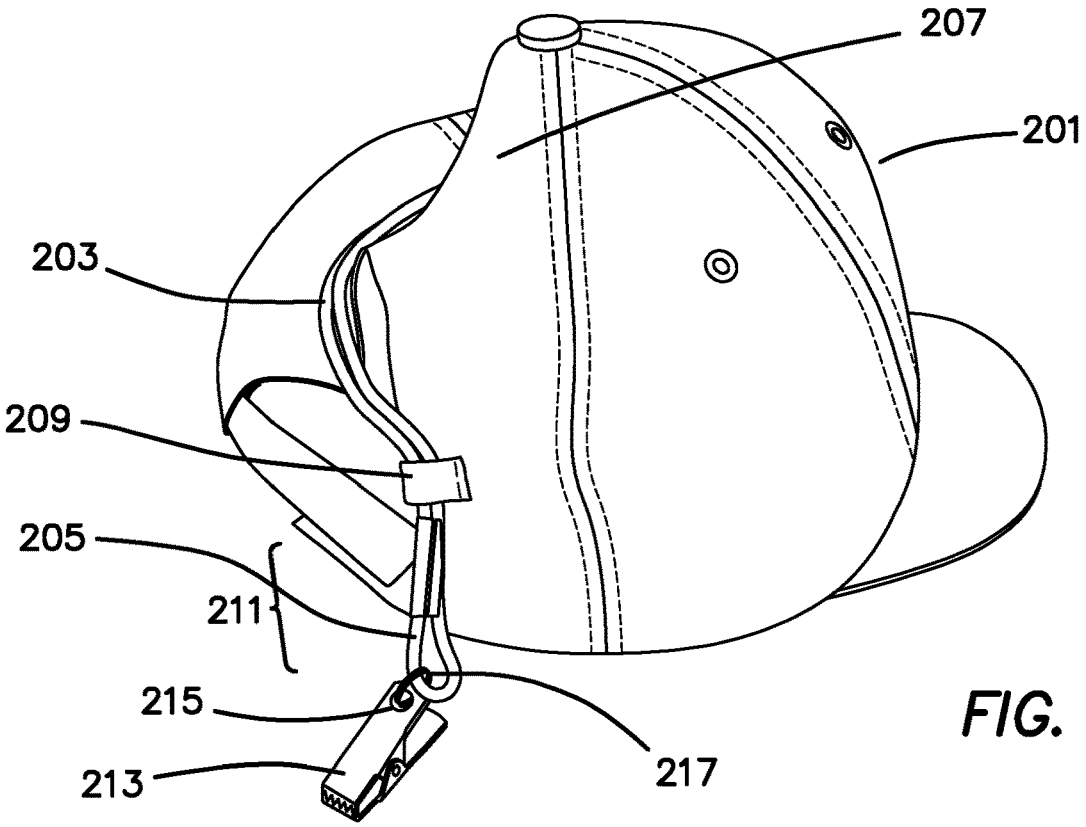
FIG. 18 is a bottom view of a baseball-type hat comprising another example of the attachment assembly of the invention.

In FIG. 18 a baseball cap-type hat 201 is shown having an attachment assembly 203 comprising a cord 205 comprising a length of doubled polymeric braided fiber. However, in other examples the cord may be made of any suitable material include a fabric, fibrous material, or a metal. A top end of the cord is sewn to an attachment point (see FIG. 19) on the outside posterior portion 207 of the crown of the hat. The cord extends downward from this attachment point and extends through a loop of fabric 209 having two ends sewn to the outside surface of the hat. The doubled bottom end of the cord 211 terminates in an alligator-type clamp fastener 213, for fastening to e.g., an article of clothing. The fastener comprises a hole 215 through which a keychain ring 217 is secured; a single braid of the cord 219 is also looped through the keychain ring.

Figure 19:
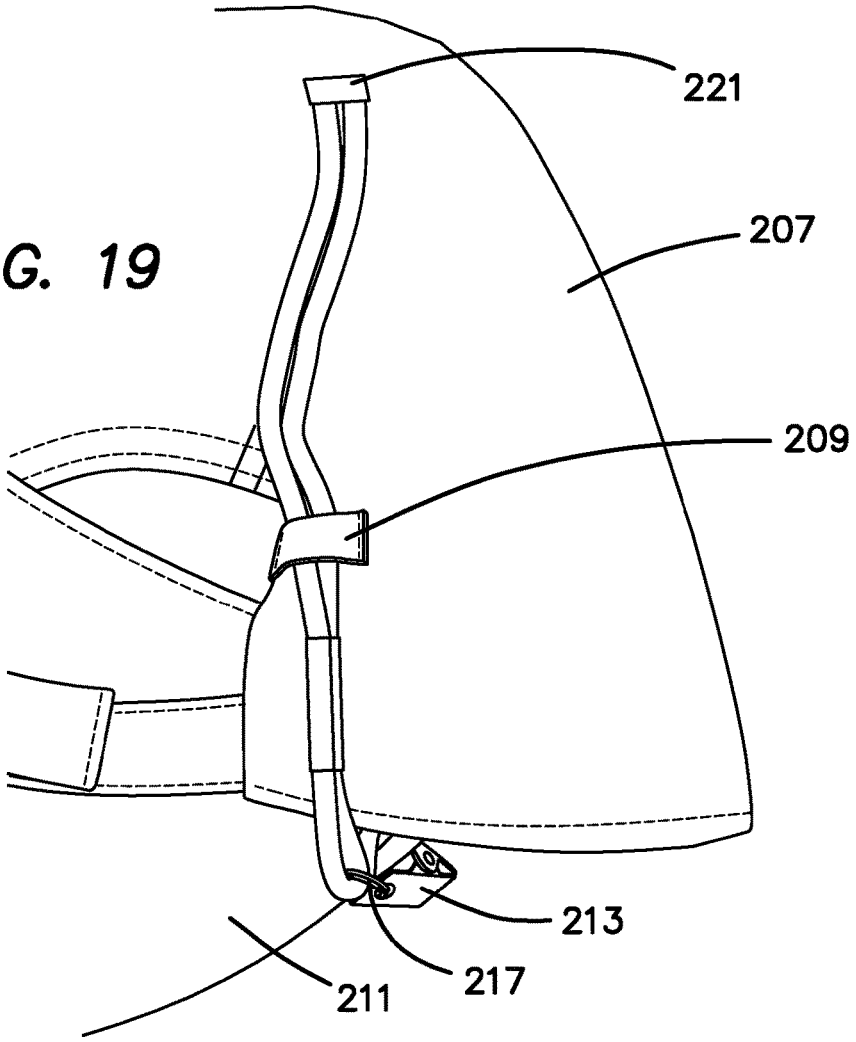
FIG. 19 is a close-up view of the posterior portion of the hat shown in FIG. 18.
Figure 20:
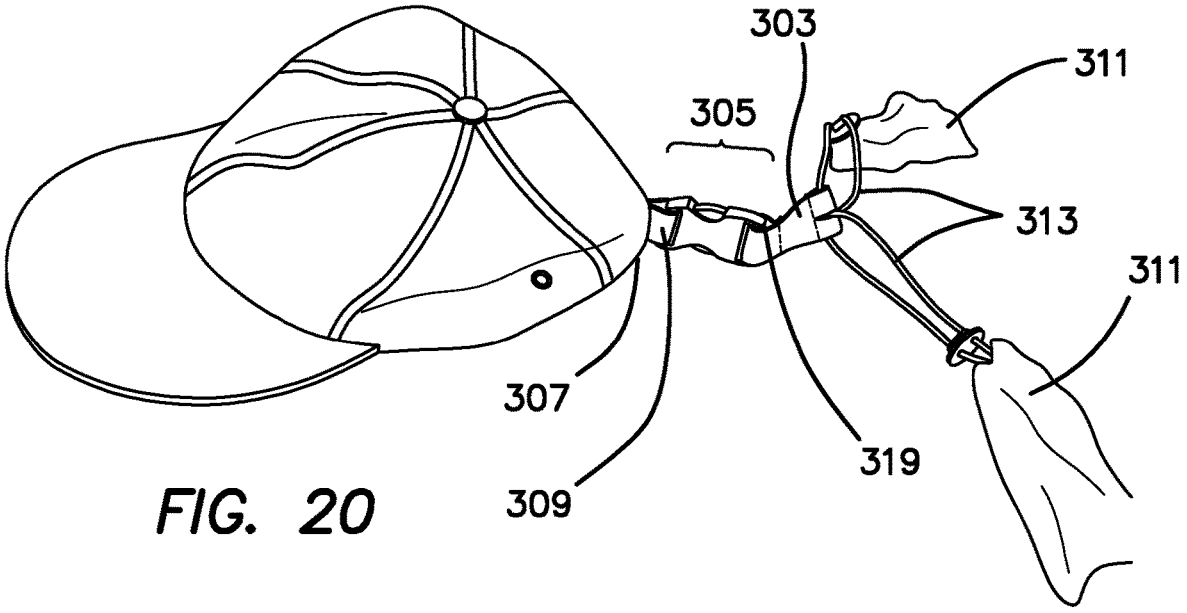
FIG. 20 is an example of a baseball-type hat comprising a detachable attachment assembly of the invention.

FIG. 19 is another view of the hat of FIG. 18 showing the attachment point 221 for the top end of the cord on the outside posterior portion 207 of the crown of the hat. This view also shows a close up view of the loop of fabric 209 having two ends sewn to the outside surface of the hat, and the bottom end of the cord 211, the keychain ring 217 and the alligator-type clamp fastener 213. FIG. 20 shows another baseball-type hat comprising an attachment assembly 301 comprising a cord 303 comprising a polymeric strap having a polymeric sliding side-release buckle assembly 305. One end of the polymeric buckle assembly 305 is attached to an posterior portion of the crown of the hat 307 by a fabric loop 309 having ends attached to the crown of the hat. The other end of the polymeric buckle assembly is attached to each of two magnet assemblies 311 secured to the ends of two elastic ligatures 313. The magnet assemblies are structured to permit opposite poles to align. Alternatively, the magnetic materials may comprise a magnet and a magnetically attractive substance, such as iron.

Figure 21:
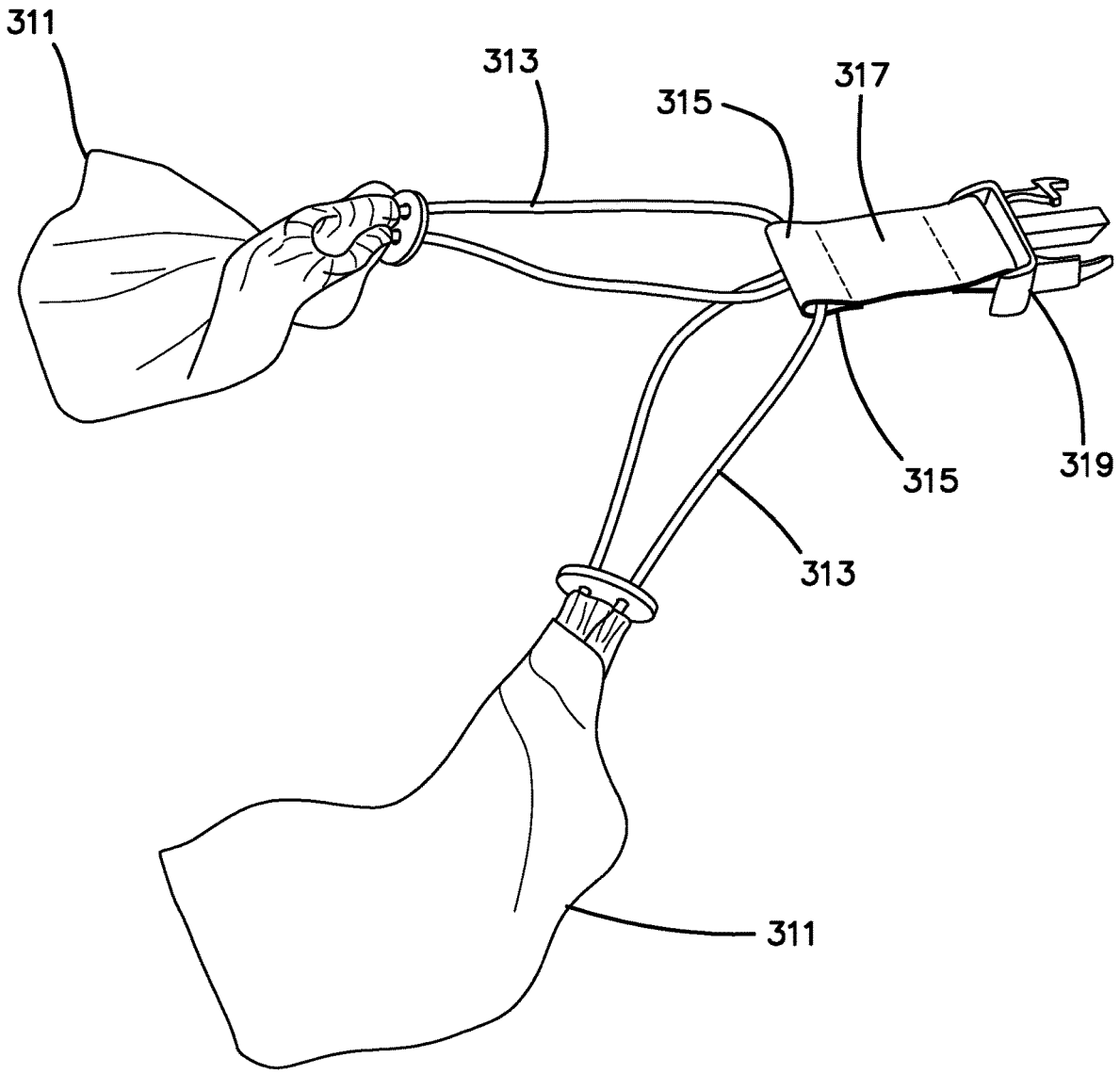
FIG. 21 shows the detached portion of the attachment assembly shown in FIG. 20.

As better shown in FIG. 21, the two elastic ligatures 313 are each connected to the polymeric buckle assembly through each of two fabric loops 315 sewn as part of a short length of the polymeric strap 317. Those of skill in the art recognize that the ligatures 313 need not be elastic in every example of the invention and may be joined by a single attachment point (rather than by multiple attachment points, as here) to the length of polymeric strap. Similarly, the attachment of the buckle may be accomplished by any suitable method and shall remain within the scope of this invention.

The other end of the polymeric strap 317 of this example is joined to a male portion 319 of the polymeric sliding side-release buckle assembly 305. This male portion 319 of the sliding side-release buckle assembly fits largely within, and connects to a corresponding female portion (321; FIG. 20) of, the polymeric sliding side-release buckle assembly (not shown) which remains attached to the hat.

This arrangement permits the polymeric strap 317 of the attachment assembly shown in FIGS. 19 and 20 to be detached from the hat during normal wear and stored in a pocket, purse or other carrier, leaving the hat with only one fastener attached. Of course, those of ordinary skill in the art recognize that any other suitable type of fasteners may be used.

Figure 22:
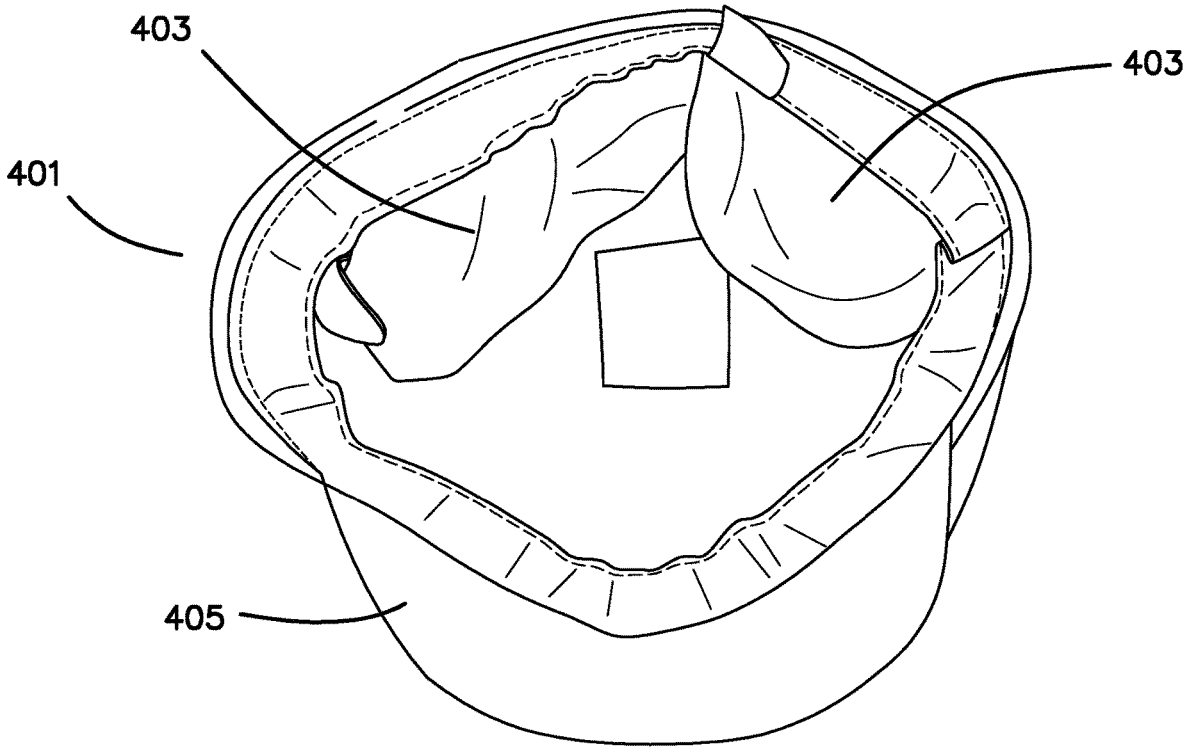
FIG. 22 is a bottom view of a foldable newsboy-type hat showing placement of fasteners for securing the hat in a folded configuration.

FIG. 22 is a view showing the interior portion of a soft tweed newsboy-type hat, 401. One or more first magnetically attractive materials (such as magnets) 403 are placed in the lining of the crown of the hat toward the posterior bottom portion thereof, and one or more additional magnetically attractive materials (such as magnets) 405 are placed in the brim of the hat in such a way as to align with and be attracted to the additional magnetically attractive material(s) 403 in the lining of the bottom crown of the hat when folded over additional magnetically attractive material(s) in the brim 405 as shown in FIG. 23, thereby magnetically securing and holding closed the folded hat.

Figure 23:
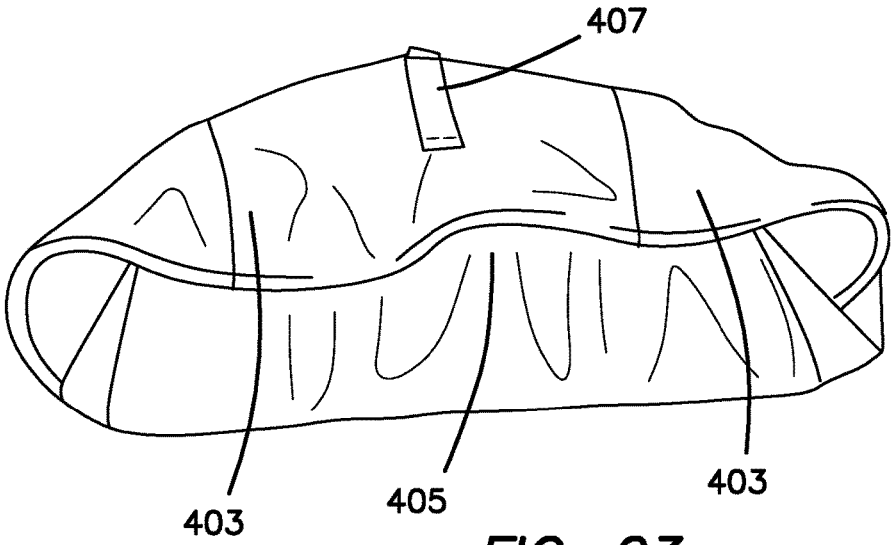
FIG. 23 shows the hat of FIG. 22 in a folded and secured configuration.

Also as shown in FIG. 23, an attachment assembly, in this case comprising a sewn loop of fabric 407, is located on the posterior crown of the hat so that the secured, folded hat may be worn on an article of clothing, such as a belt. The cavity within the interior crown of the hat may be used to store small items such a writing implements, mobile telephones, keys and the like.

Figure 24:
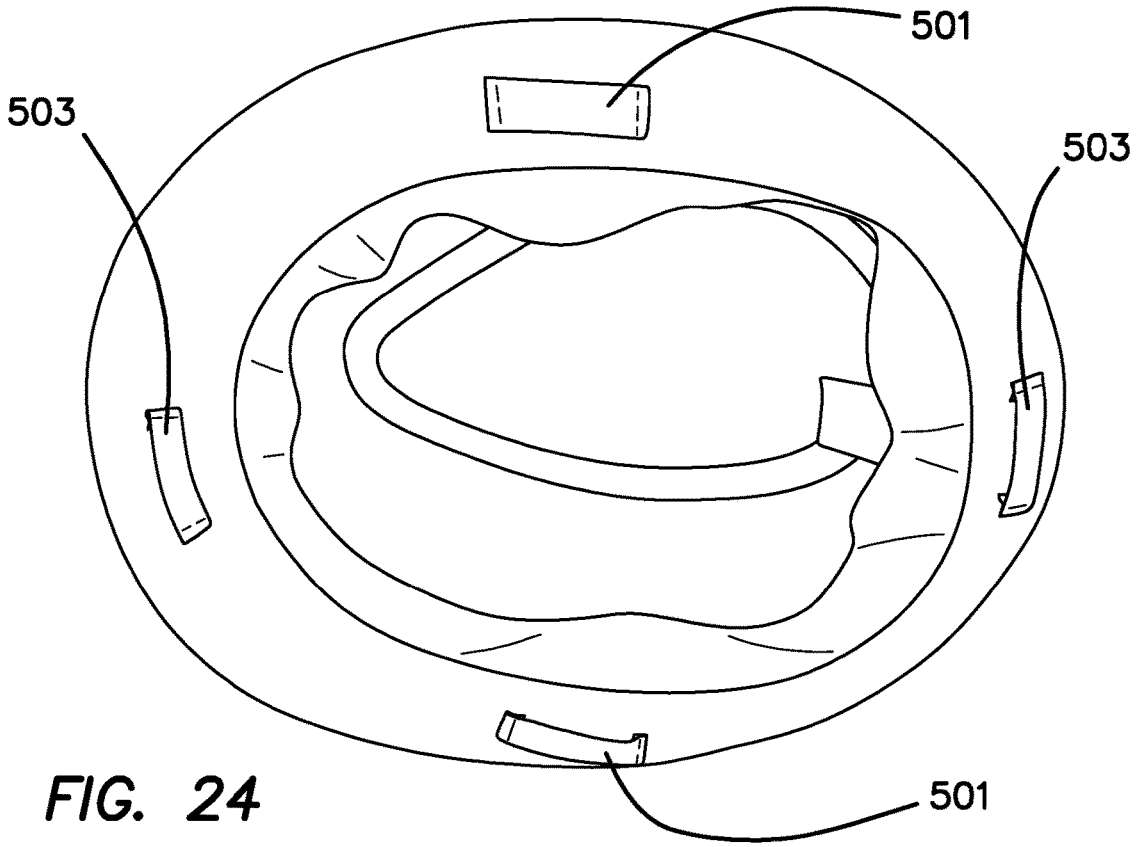
FIG. 24 is a bottom view of a further Panama-style hat comprising an example of the attachment assembly of the invention.

FIG. 24 depicts an inverted view of a Panama-style hat with an attachment assembly comprising two pairs of loops located on the underside of the hat brim; a first pair of loops 501 attached at the left and right sides of the brim, and a second pair of lops 503 attached to the anterior and posterior of the underside of the hat brim.

Each loop comprises a length of material joined (e.g. sewn) to the underside of the hat brim. As shown, the loops of each pair of loops are aligned to be parallel to each other. In this version, both loops of each pair of loops are oriented at a 90° angle to the other pair; however, in other examples, all the loops may be oriented in a parallel arrangement.

Figure 25:
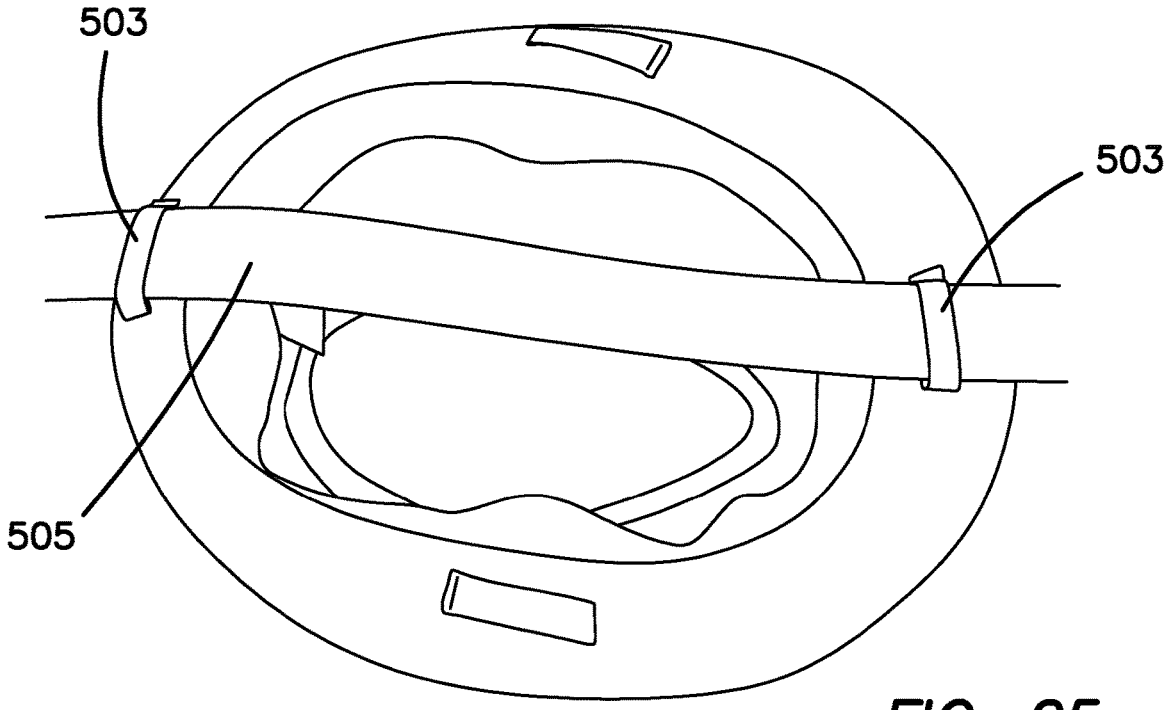
FIG. 25 shows the Panama-style hat of FIG. 24 in which the hat is arranged to be worn on a belt.

FIG. 25 shows the same view of the Panama-style hat shown in FIG. 24, with a waist belt 505 inserted through one of the two pairs of loops. In this way, the hat may be worn on the belt when not being used, with the crown facing outwards from the body.

Figure 26:
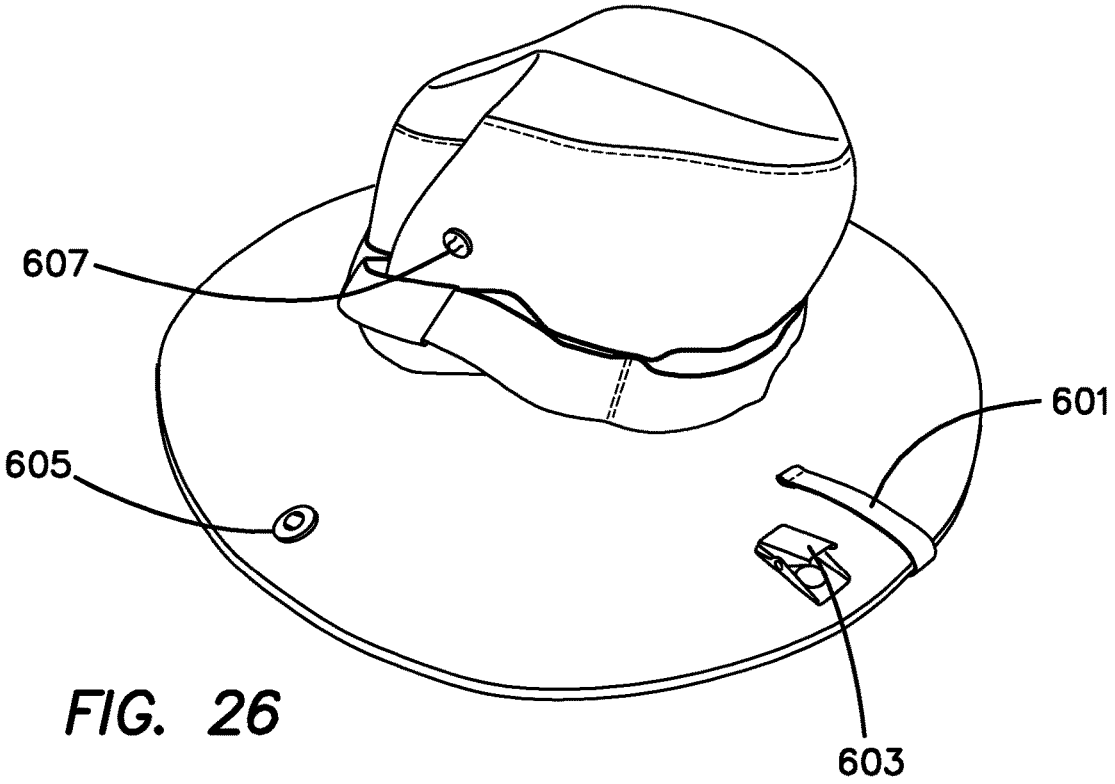
FIG. 26 shows a safari-style hat comprising an attachment apparatus and a strap for folding the hat when not in use.

FIG. 26 is a view of a soft "safari"-style hat having a female snap fastener on the brim 603 and a male snap fastener on the crown 607 thereof to permit the brim to be folded against a side of the crown when worn, if desired. Those of skill in the art recognize that the choice of which location to place the male snap fastener and the female snap fastener is merely a matter of personal choice.

Figure 27:
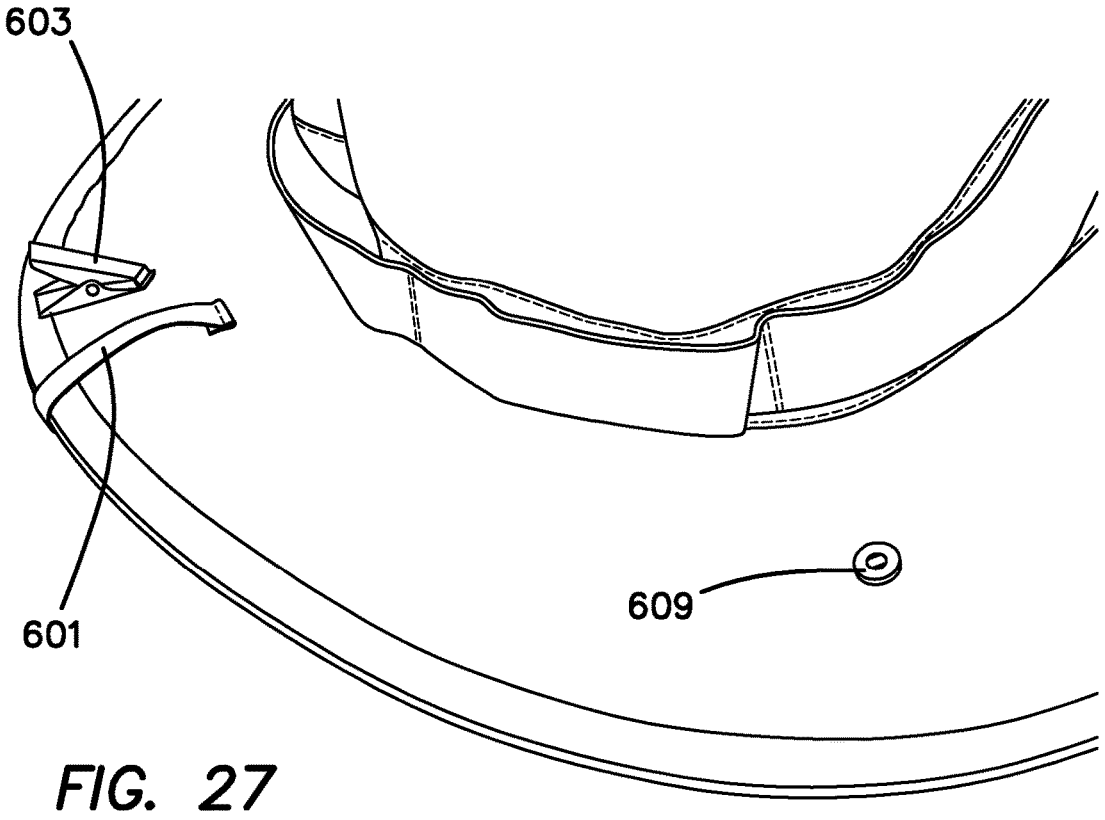
FIG. 27 shows a close-up of the brim of the safari-style hat of FIG. 26.
Figure 28:
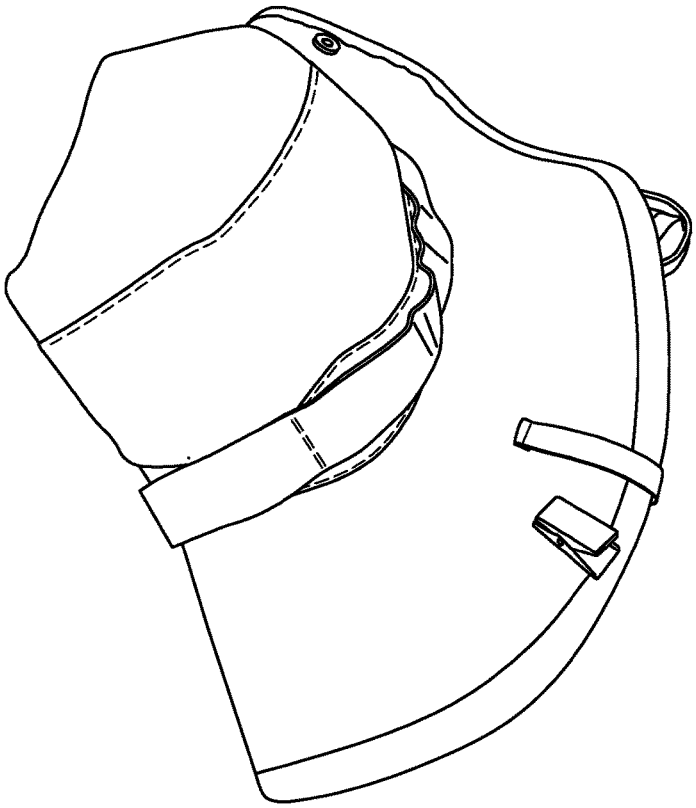
FIG. 28 shows a partially folded safari-style hat of FIG. 26.
Figure 29:
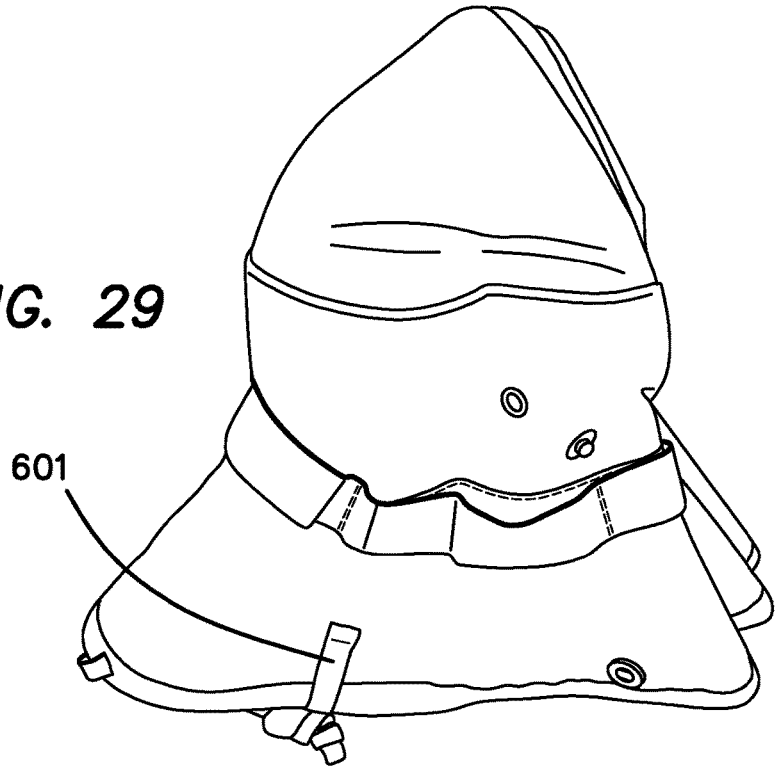
FIG. 29 shows a folded and secured safari-style hat of FIG. 26.

An attachment assembly comprises a fastener (in this case, alligator-type clip 603) affixed to the brim of the hat. Additionally, a strap 601 preferably comprising a length of an elastic material is shown also affixed to the brim of the hat for folding the hat, as shown in FIGS. 27-29. The strap 601 comprises a male snap fastener at or proximal to the distal end thereof (not shown).

FIG. 27 is a close-up view of the brim of the hat shown in FIG. 26, showing the alligator-type clip 603 and strap 601, as well as a female snap fastener 609 matched to fit the male snap fastener of the strap 601, with the length and placement of the strap and fastener 609 calibrated to retain the hat together securely when in a folded configuration.

FIG. 28 depicts the hat of FIGS. 26 and 27, folded in half.

FIG. 29 depicts the hat of FIGS. 26-28 folded in quarters, with the distal end of the strap 601 fastened to fastener 609 (not shown) to hold the folded hat in the folded state. When affixed to a belt, waistband or other article of clothing in an inverted orientation using clip fastener (see FIG. 27, reference numeral 603) the inside of the crown of the hat forms a pouch for holding keys, wallets, loose change, mobile telephones and/or other small personal items.

As indicated previously, features such as, without limitation, fabrics, fastener types, and the like described or otherwise disclosed in this specification in connection with certain types of hats, cords and the like altered while remaining within the scope of this invention. Various modifications could be made in the types of fasteners used, the materials used, and so forth, without departing from the spirit of the invention. The appended claims are therefore intended to cover and embrace any such modifications within the limits only of the true spirit and scope of the invention.

The invention claimed is:

1. A securable hat assembly comprising: a hat comprising: a front portion, a back portion and a crown portion for covering a wearer's head, the crown portion including an interior side for engaging the head; the interior side having a lining and an exterior side for facing away from the head; a brim portion extending outwardly from a lower edge of the crown portion, the brim portion including an interior side and an exterior side; and an attachment assembly located on the exterior side of the crown portion at the rear portion of the hat, and oriented rearward of the crown portion for securing the hat to an article of clothing; said securable hat assembly comprising at least two mutually magnetically attractive materials, said at least two mutually magnetically attractive materials including at least one magnet and at least one magnetically attractive material, at least one said at least two mutually magnetically attractive materials being located within a lining of the brim portion of the hat and said at least two mutually magnetically attractive materials are configured to mutually magnetically attract and fasten to each other, thereby detachably holding the hat in a folded configuration; wherein said securable hat assembly lacks a pocket or zipper.

2. The securable hat assembly of claim 1 wherein said hat is soft.

3. The securable hat assembly of claim 2 wherein at least one of the at least two mutually magnetically attractive materials is located within a lining of the crown of the hat.

4. The securable hat assembly of claim 3 wherein one of said the at least two mutually magnetically attractive materials is located in a lining of the rear portion of the hat, and the other of said at least two mutually magnetically attractive materials is located in a lining of the front portion of the hat.

5. The securable hat assembly of claim 2 wherein each of the at least two mutually magnetically attractive materials is located within the lining of the interior side of the hat.

6. The securable hat assembly of claim 4 wherein the hat is maintained in a stable configuration when said rear portion of the hat is folded toward the front portion of the hat sufficiently to permit said at least two mutually magnetically attractive materials to interact, thereby detachably holding the hat in a folded configuration.

* * * * *